US005209772A

United States Patent [19]

Benn et al.

[11] Patent Number: 5,209,772

[45] Date of Patent: May 11, 1993

[54] DISPERSION STRENGTHENED ALLOY

[75] Inventors: Raymond C. Benn; Gaylord D. Smith; John J. Fischer, all of Huntington, W. Va.

[73] Assignee: Inco Alloys International, Inc., Huntington, W. Va.

[21] Appl. No.: 254,318

[22] Filed: Oct. 5, 1988

Related U.S. Application Data

[63] Continuation of Ser. No. 897,745, Aug. 18, 1986, abandoned.

[51] Int. Cl.[5] ..... C22C 29/12; C22C 29/00

[52] U.S. Cl. ..... 75/233; 75/232; 75/234; 75/235; 75/236; 75/237; 75/238; 75/239; 75/240; 75/244

[58] Field of Search ..... 75/232, 233, 234, 235, 75/236, 237, 238, 239, 240, 244; 419/12, 13, 17, 18, 19, 28, 32

[56] References Cited

U.S. PATENT DOCUMENTS

| | | | |
|---|---|---|---|
| 3,591,362 | 7/1971 | Benjamin | 428/570 |
| 3,660,049 | 5/1972 | Benjamin | 75/235 |
| 3,720,551 | 3/1973 | Allen | 419/10 |
| 3,778,249 | 12/1973 | Benjamin et al. | 75/232 |
| 3,837,930 | 9/1974 | Cairns et al. | 419/13 |
| 3,912,552 | 10/1975 | Schultz et al. | 148/31 |
| 3,992,161 | 11/1976 | Cairns et al. | 75/234 |
| 4,075,010 | 2/1978 | Fischer | 75/235 |
| 4,086,085 | 4/1978 | McGurty | 420/43 |
| 4,402,746 | 9/1983 | Ramanarayanan et al. | 75/252 |
| 4,419,130 | 12/1983 | Slaughter | 75/244 |

FOREIGN PATENT DOCUMENTS 0091260 10/1983 European Pat. Off. .

OTHER PUBLICATIONS

Kornilov, "Aluminum in Iron and Steel" by S. C. Case and K. R. Van Horn, John Wiley and Sons (1953).

R. Allen and R. Perkins "Contract Report for the Naval Air Systems Command", May 1973.

McGurty, J. A., Nekkanti, R. and Moteff, J. "High Aluminum, Low Chromium Austenitic Stainless Steel".

*Primary Examiner*—Robert L. Stoll
*Assistant Examiner*—Nina Bhat
*Attorney, Agent, or Firm*—Francis J. Mulligan, Jr.; Edward A. Steen

[57] ABSTRACT

A dispersion-strengthened (DS) alloy, more particularly oxide-dispersion-strengthened (ODS) iron-based alloys which manifest resistant to oxidation at temperatures as high as 1300° C. (approx. 2400° F.) whereby the alloys are useful in the production of advanced aircraft gas turbine engine components and in demanding industrial applications.

4 Claims, 6 Drawing Sheets

DISPERSION STRENGTHENED ALLOY

This is a continuation of U.S. patent application Ser. No. 897,745, filed Aug. 18, 1986, now abandoned.

FIELD OF INVENTION

The present invention is directed to dispersion-strengthened (DS) alloys, and more particularly to oxide-dispersion strengthened (ODS) iron-base alloys which manifest an exceptional degree of resistance to oxidation at temperatures as high as 1300 C. (approx. 2400° F.) whereby the alloys are useful in the production of advanced aircraft gas turbine engine components and in demanding industrial applications.

BACKGROUND OF INVENTION

In U.S. Pat. No. 3,992,161 ('161) ODS iron-chromium alloys are described as having very good oxidation resistance coupled with high-strength at elevated temperatures. The results set forth therein reflect a decided improvement over iron-chromium alloys produced by the more conventional melt/ingot processing practices. More specifically, it was disclosed that the ODS alloys could be produced by the now well known Mechanical Alloying process, a technology developed nearly twenty years ago and described in such U.S. Pat. Nos. as 3,591,362 and 3,837,930.

Notwithstanding the virtues of the '161 alloys such materials have been found wanting in certain aerospace and industrial environments. By way of explanation, though the '161 ODS material (commercially contains about 20% chromium, 4.5% aluminum) exhibits good corrosion and oxidation resistance at, say, up to 1200° C., it is prone to undergo premature slagging attack (formation of low melting point phases/compounds through a chemical reaction with corrosive deposits from and/or the environment per se) and/or accelerated attack upon exposure at higher temperatures after short intervals of time, the failure being of the catastrophic type. In this connection, accelerated oxidation may be considered as the rapid mass change of an alloy by oxidation. The mass change is virtually always dramatically positive if all the oxide is collected and weighed. In undergoing the ravages occasioned by such attack the alloy surface converts to friable iron oxide and iron-chromium spinels.

For example, burner cans in aircraft gas turbine engines of advanced design are currently intended for use at increasingly higher operating temperatures, i.e., about 1250° C. (2308° F.), and above, e.g., 1300° C. (2372° F.). Similarly, industrial applications involving intimate contact with such aggressive corrosives as flue dust, fly ash, molten glass, etc. require more oxidation and/or corrosion-resistant materials.

Apart from the above, what is also required for such applications is a material which offers in addition to high strength at operating temperatures, including stress-rupture and tensile characteristics, sufficient fabricability that it can be formed into flat rolled products such as sheet, strip, etc, which product forms can be formed into tubing, rings, canisters and other shapes. Without fabricability the utility of an ODS material is significantly diminished.

Apart from '161 reference also might be made to the work of Kornilov, "Aluminum in Iron and Steel" by S. C. Case and K. R. Van Horn, John Wiley and Sons (1953). Kornilov studied the effect of up to 10% aluminum and up to 65% chromium on scaling losses in both cast and wrought Fe-Cr-Al alloys. Aluminum benefited scaling resistance but seemingly there was little benefit conferred by chromium beyond the 25% level at 1100°-1400° C. Nothing in the Kornilov investigation involved fabricability of an ODS product or manufacture of sheet.

R. Allen and R. Perkins (in a contract report for the Naval Air Systems Command, May 1973) investigated ODS iron-chromium-aluminum-yttrium alloys with 16-25% chromium at an aluminum level of 5.7-6.0% versus conventional wrought and cast 25% Cr/4% Al and 15% Cr/4% Al alloys. It was indicated that such alloys could be extruded but nothing was given in terms of fabricability and the production of, say, the important sheet product form.

SUMMARY OF INVENTION

Figure 1:
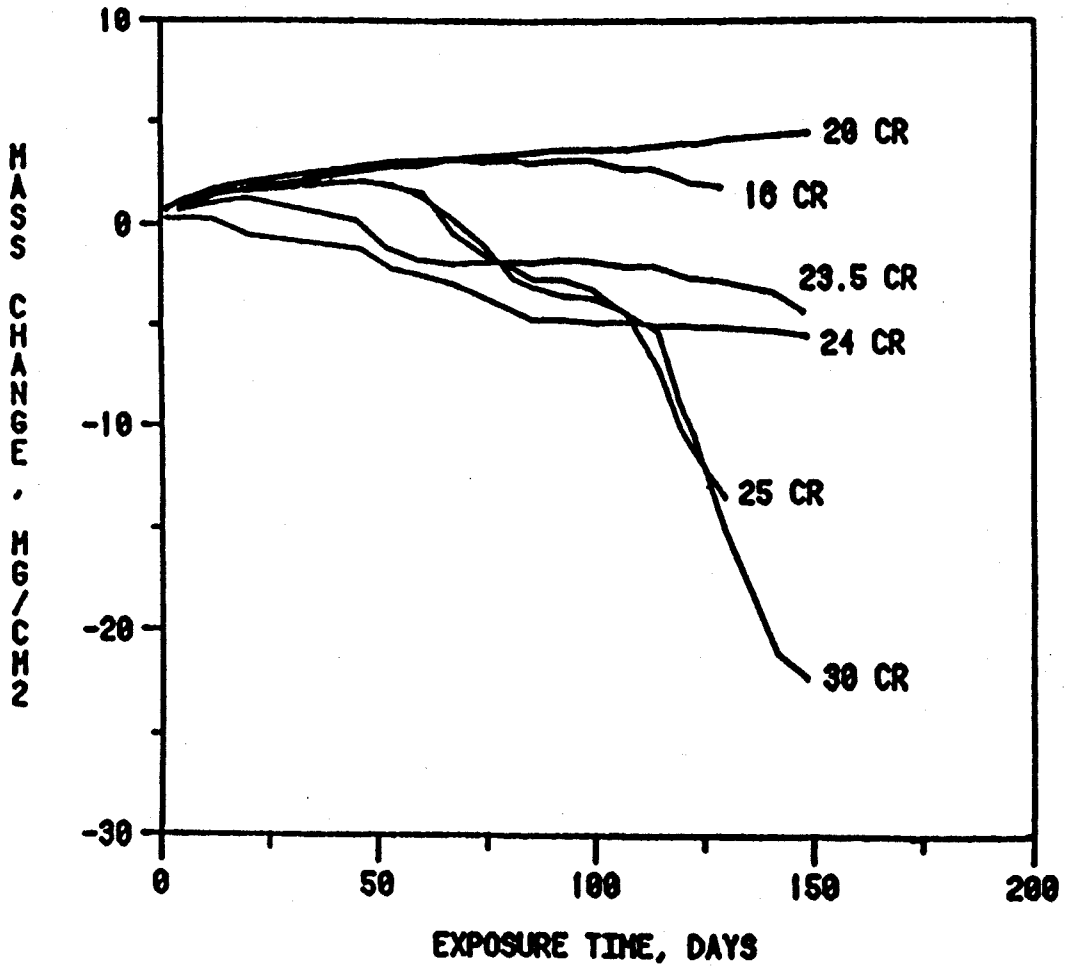
FIG. 1 is a graph interrelating mass change and days of exposure of alloys to oxidation at 1200° C.

It has now been found that certain ODS iron-base compositions having special and correlated percentages of chromium and aluminum and a refractory dispersoid afford an outstanding degree of resistance to oxidation/-corrosion such that the alloys can be used in the hot sections of gas turbine engines, e.g., burner cans, and in industrial applications where aggressive corrosives are encountered, e.g., molten glass, flue dust, fly ash, etc.

INVENTION GENERALLY AND EMBODIMENTS

Generally speaking, the present invention contemplates dispersion strengthened powder metallurgically produced iron-chromium-aluminum alloys containing about 22.5 to 30% chromium and about 5 to 8% aluminum. Where flat rolled products are required, e.g., sheet, for intended use and thus a significant degree of fabricability is necessary, the aluminum content should not exceed 6.25% the aluminum should be from about 5% to 6.25%. Advantageously, in this regard, the chromium should be from 23 to 27% and the aluminum from 5 to 6%. The alloys may also contain up to 5% titanium, up to 2% each of zirconium, hafnium, tantalum and vanadium, up to 6% each of molybdenum and tungsten, up to 0.5% each of silicon and niobium, up to 0.05% each of calcium, yttrium and rare earth metals, up to 0.2% boron and the balance essentially iron plus, to enhance strength, a small but effective amount, e.g., 0.2 volume % of at least one finely divided dispersoid having a melting point of at least about 1510° C. (2750° F.) and selected from the group consisting of oxides, nitrides, carbides, borides and other refractory metals. In this connection oxides may be present up to about 10 volume % whereas carbides should not exceed about 2 volume %. Nitrides and borides need not exceed 5% by volume.

In carrying the invention into practice, the chromium should not exceed 30% to minimize the formation of deleterious levels of topologically close packed (TCP) phases such as sigma, phases which adversely impact mechanical properties. Given cost, there is no significant benefit derived with chromium percentages above about 27%. The percentage of chromium can be extended downward to 20% where less demanding operational parameters are contemplated but at the risk oxidation resistance will be decreased at a given aluminum level.

Aluminum should be from about 5% to 8% for oxidation and corrosion resistance but as indicated, supra, preferably should not exceed 6% when seeking the optimum in terms of fabrication into sheet, strip, etc. Such elements as nickel and cobalt are not required and confer no particular advantage. Carbon need not exceed 0.1% though higher percentages can be tolerated. Our investigation has not shown silicon or boron to be particularly beneficial. Boron is thought to be causative of (or a contributor to) distortion when the sheet product form is heat treated at elevated temperatures. It preferably should not exceed 0.1%. Such constituents as titanium, zirconium, tantalum, niobium, hafnium, zirconium and vanadium need not exceed 1%. Tantalum, for example, at the 1% level has resulted in a loss of fabricability. It tends to stiffen the alloys of the invention and possibly raises the ductile-brittle trans-formation temperature too much. A range of titanium from 0.2 to 0.75% is preferred.

The alloys of the invention are most preferably produced by Mechanical Alloying as described in U.S. Pat. No. 3,992,161, incorporated herein by reference, although other dispersoid strengthening powder metallurgy processes may be employed.

To give those skilled in the art a better understanding of the invention the following information and data are presented.

A series of alloy compositions were prepared using raw material powders namely, elemental (e.g., Fe, Cr, Al), master alloy (e.g., Fe-Cr-Al-Ti) and yttrium bearing oxide ($Y_2O_3$) which powders were thereafter blended to produce the chemistries given in Table I. The powder blends were mechanically alloyed (MA) in high energy ball mills under an argon atmosphere for about 24 hours at a ball-to-powder ratio of about 20:1 using steel balls as the impacting/grinding media. The MA powders were screened to remove the coarser particles (above about 600 microns), placed in mild steel cans, sealed and hot compacted by extrusion. The extrusions were decanned and then hot and cold rolled to 1.25 mm (0.05 in) thick sheet, the sheet thereafter being subjected to a final anneal which was typically 1315° C. (2400° F.) for 1 hour to achieve recrystallization.

TABLE I

| | Composition (Weight Percent) | | | | | | | | | | | |
|---|---|---|---|---|---|---|---|---|---|---|---|---|
| Alloy | C | Si | Mn | Al | Cr | Ti | P | S | N | O | Fe | $Y_2O_3$ |
| A | 0.016 | 0.10 | 0.13 | 4.36 | 16.04 | 0.27 | 0.011 | 0.006 | 0.052 | 0.21 | Bal. | 0.27 |
| B | 0.020 | 0.14 | 0.14 | 4.36 | 20.07 | 0.36 | 0.007 | 0.001 | 0.040 | 0.18 | Bal. | 0.36 |
| C | 0.023 | 0.08 | 0.10 | 4.27 | 19.50 | 0.36 | 0.006 | 0.004 | 0.028 | 0.20 | Bal. | 0.5* |
| D | 0.019 | 0.09 | 0.13 | 4.41 | 23.50 | 0.34 | 0.007 | 0.007 | 0.038 | 0.19 | Bal. | 0.34 |
| E | nd | nd | nd | 4.3 | 24.0 | nd | nd | nd | 0.023 | 0.28 | Bal. | 0.5* |
| F | nd | nd | nd | 4.5 | 25.0 | 0.5 | nd | nd | 0.051 | 0.42 | Bal. | 0.5* |
| G | nd | nd | nd | 4.5 | 30.0 | 0.5 | nd | nd | 0.029 | 0.42 | Bal. | 0.5* |
| H | 0.021 | 0.16 | 0.16 | 6.58 | 24.73 | 0.42 | 0.010 | 0.005 | 0.075 | 0.21 | Bal. | 0.42 |
| I | 0.030 | 0.02 | — | 5.50 | 20.93 | 0.47 | — | — | 0.100 | 0.62 | Bal. | 0.66 |

NOTE:
nd = Not Determined
Bal = balance iron
**Nominal

Standard size specimens were cut from the sheets produced and the ground to approximately 600 grit for use in accelerated oxidation tests. Cyclic oxidation testing was used and this consisted of exposing samples at temperatures of 1200° C., 1250° C. and 1300° C. in air+5% $H_2O$ for 24 hour cycles then cooled to room temperature and weighed. Results are reported in Tables II and III.

TABLE II

| | Time (hours) Before Initiation of Accelerated Oxidation At | | |
|---|---|---|---|
| Alloy | 1200° C. | 1250° C. | 1300° C. |
| A | 3216* | 1152 | 168 |
| B | 4704 | 1838** | 348 |
| C | 4800 | n.d. | n.d. |
| D | 4224 | 1992 | 168 |
| E | 3384 | 1656 | 528 |
| F | 3384 | 1320 | 148 |
| G | 4498 | 1656 | 480 |
| H | 8208 | 3216 | 600 |
| I | 4656 | 3624 | 576 |

*Average of 2 results
**Average of 5 results
nd = not determined

In Table III below the times from initiation of accelerated oxidation to completion are reported:

TABLE III

| Alloy | Compositional Variation, Wt. % Cr/Al | Time from Initiation of Accelerated Oxidation to Completion* at 1300° C. |
|---|---|---|
| B,C | 20/4.3 | less than 2 days |
| D | 23.5/4.4 | 5 days |
| H | 24.7/6.5 | 10 days |
| H | 24.7/6.5 | 21 days at 1200° C. |

*Completion defined as Attack over 100% of surface area of specimen.

An examination of the data in Table II and III reflects that increasing the chromium level from 16% to 20% resulted in some improvement in oxidation resistance at a constant aluminum level, Alloy A vs. Alloys B and C, the results being quite poor at the 1300° C. test temperature. However, raising the chromium level to 23.5%, Alloy D, did not manifest any significant improvement, particularly at the 1300° C. test condition.

Alloys B, and C are representative of a typical '161 composition, i.e., 20% Cr/4.5% Al. At 1300° C., the initiation of accelerated oxidation to the point of completion spanned but 2 days. See Table III. Increasing the chromium content to 24% reduced in half the rate of accelerated oxidation (Alloy D, Table III) and increasing the aluminum level from 4.5 to 6.5% again markedly reduced the rate of attack (Alloy H, Table III). This pattern of behavior is of practical importance because a significant reduction in the rate of attack may extend service life to allow a repair operation and, thus, avoid the consequences of a catastrophic failure.

Figure 2:
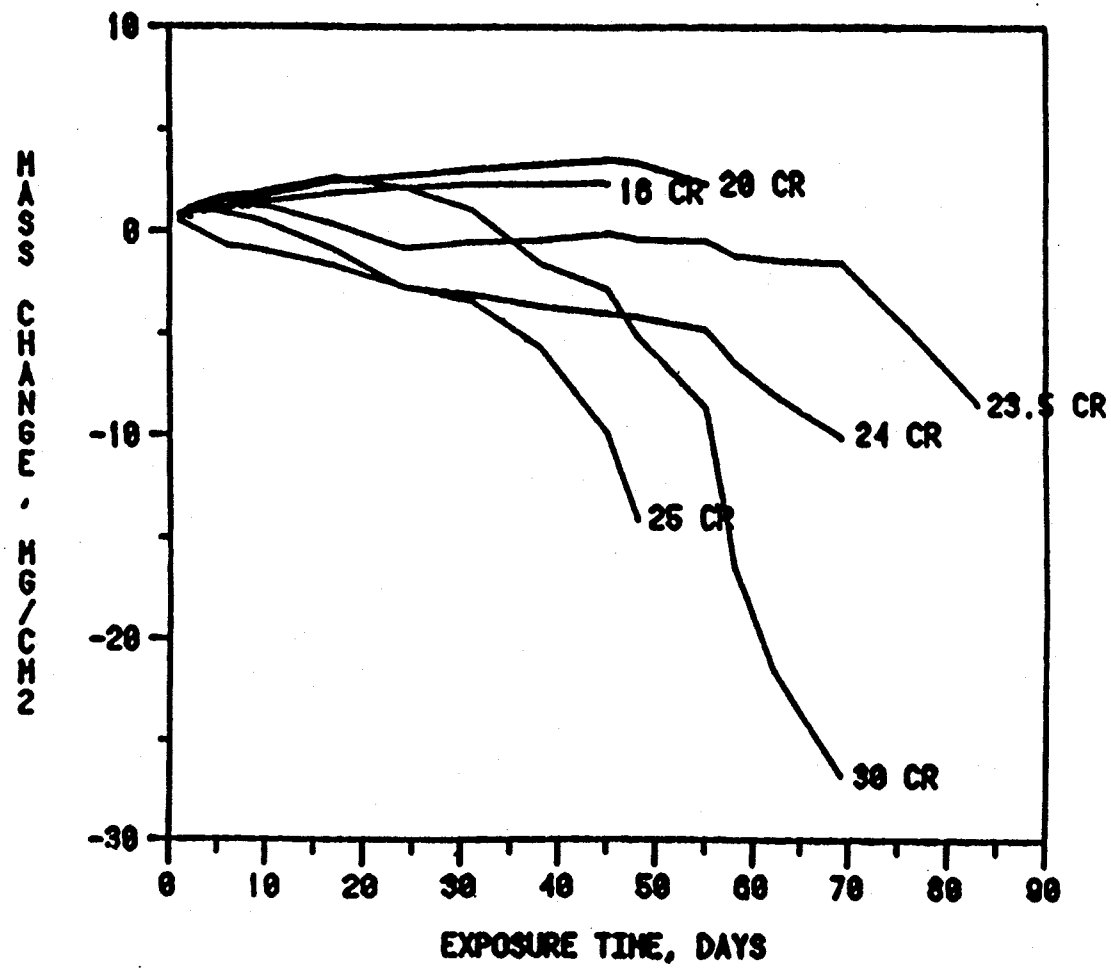
FIG. 2 is a graph similar to that of FIG. 1 except that exposure is at 1250° C.
Figure 3:
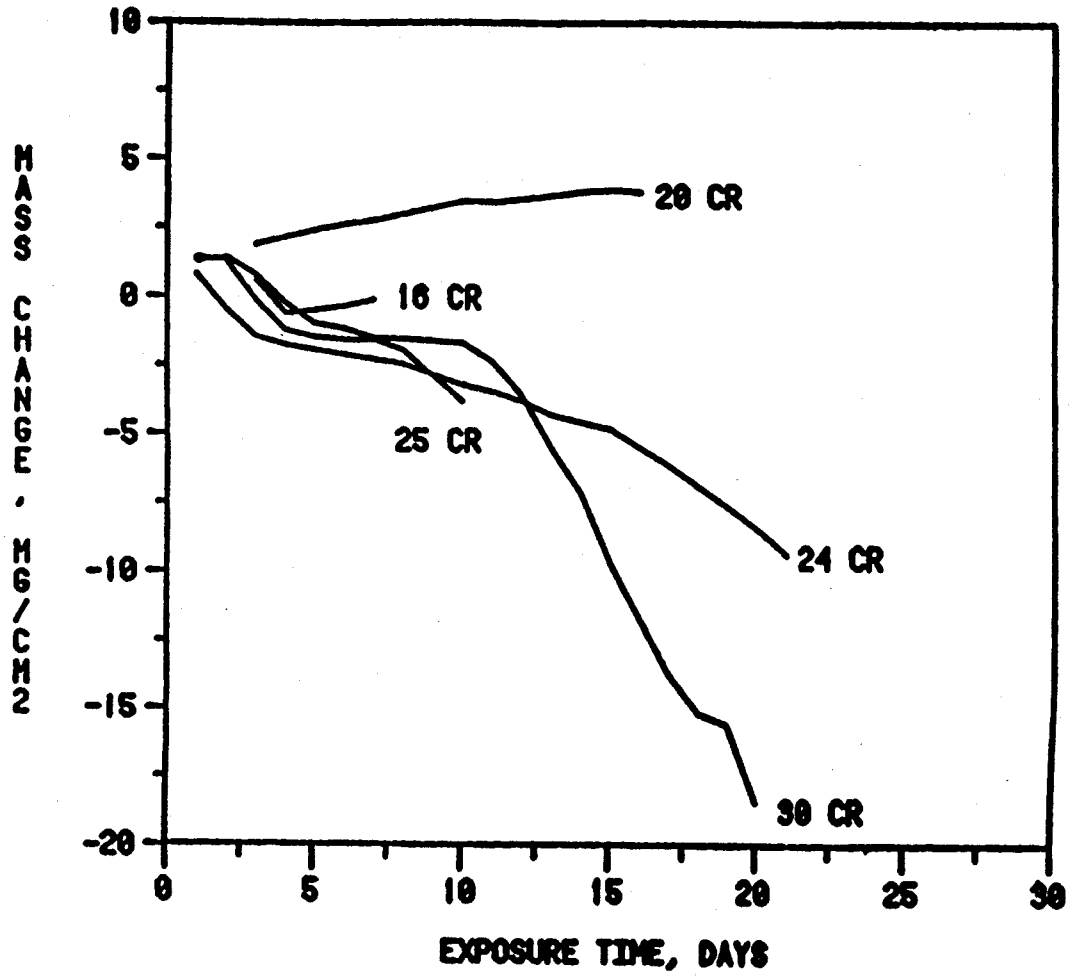
FIG. 3 is a graph similar to that of FIGS. 1 and 2 except that exposure is cyclic in moist air at 1300° C.
Figure 4:
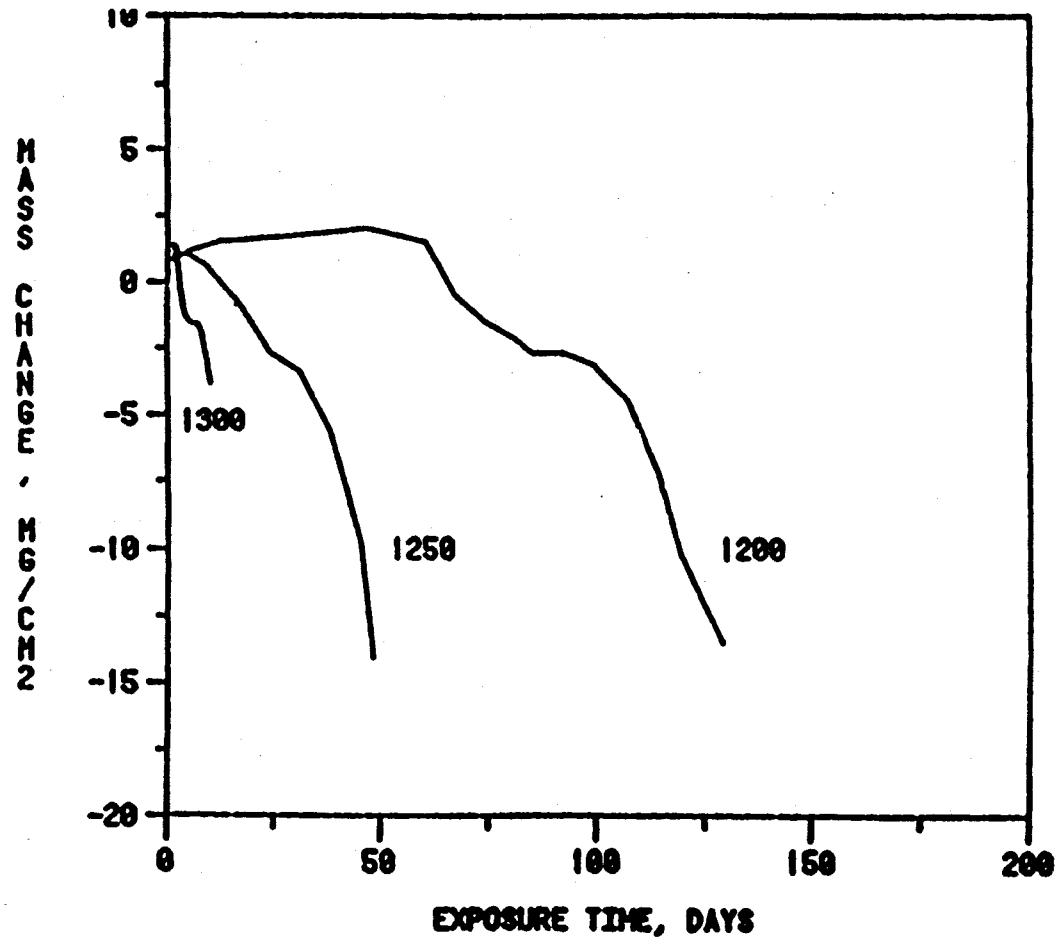
FIG. 4 is a graph similar to that of FIG. 3 showing results of cyclic exposure of an alloy in moist air at various temperatures.
Figure 5:
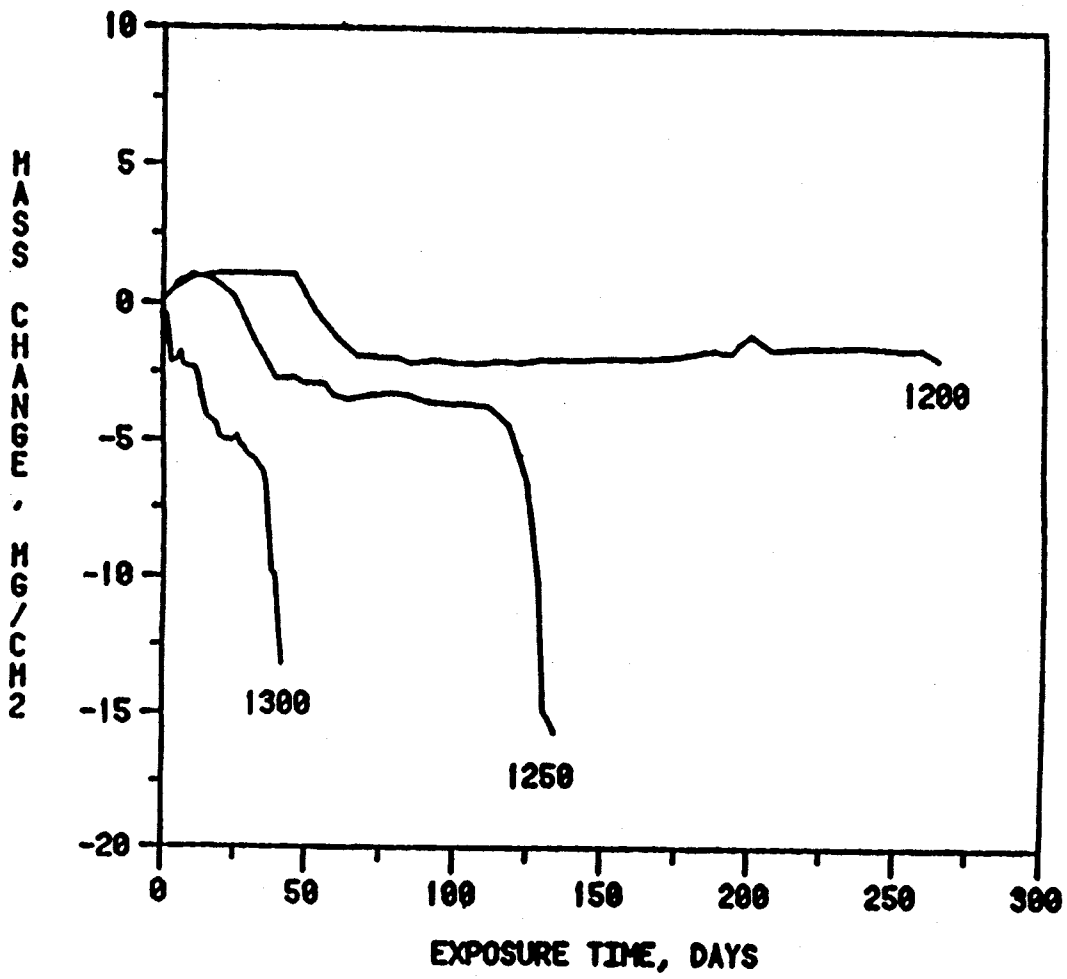
FIG. 5 is a graph similar to that of FIG. 4.
Figure 6:
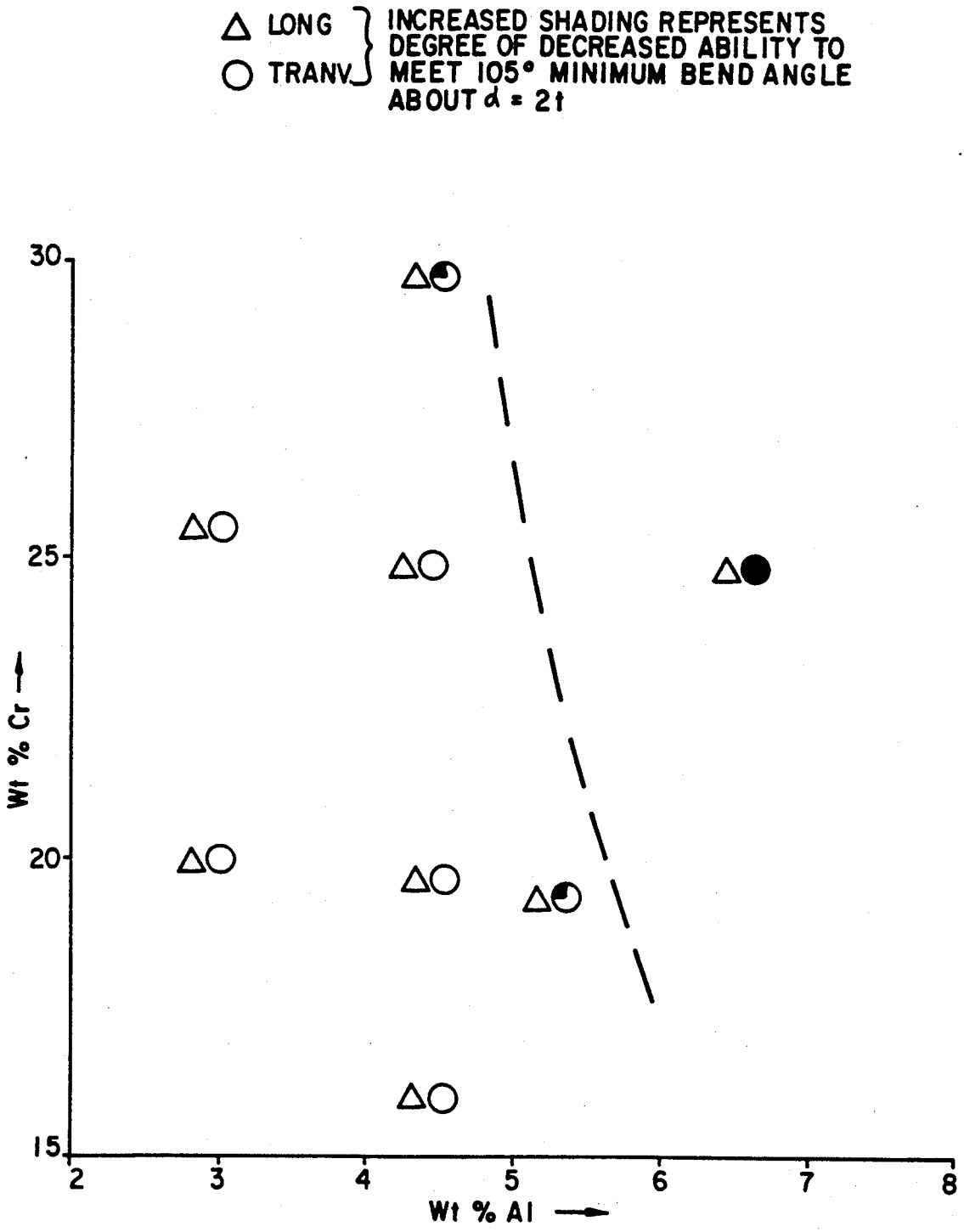
FIG. 6 is graph depicting formability of an alloy as a function of chromium and aluminum content.

FIGS. 1–3 illustrate more graphically what happens by increasing the chromium level of a typical commercial '161 alloy which contained, apart from the different chromium levels, 0.02% C, 4.5% Al, 0.3% Ti, 0.5% $Y_2O_3$, incidental impurities, with iron being essentially the balance. At each test temperature of 1200° C., 1250° C. and 1300° C., the spallation rate (mass change) was greater in respect of the higher percentage of chromium. In accordance with the subject invention, the aluminum content should also be increased, preferably proportionately, to reduce the rate of spallation and ensure better integrity of the alloy composition. This is reflected by FIGS. 4 and 5 where at a 25% Cr level the spallation rate is markedly reduced through the co-presence of an additional 2% of aluminum above the '161 alloy.

A further practical advantage of the alloys of our invention is that they are deemed to afford improved high temperature oxidation and corrosion resistance in thin gauges in comparison with prior art material. Sheet thickness, for example, of 1.25 mm (0.05 in.) are typical for the 20 Cr/4.5 Al '161 alloy as commercially produced. In such gauge section there is a propensity to undergo accelerated oxidation attack early on for lack of, comparatively speaking, bulk concentration of aluminum and chromium atoms available for surface (oxide) protection. Put another way, such accelerated attack can cause pitting, pitting which will penetrate through, for example, sheet. Alloys of the invention offer a higher concentration of reserve aluminum and/or chromium atoms.

With regard to fabricability FIG. 7 depicts a general correlation between chromium and aluminum in respect of their combinative effect on bendability, a criterion used to assess fabricability. In this connection, sheet specimens approximately 0.05 in. (1 t) thick, ½ inch in width and about 2 to 4 inches in length were bent over a rod of approximately 0.1 inch thick (2 t). Tests were made in both the longitudinal and transverse directions. The black shaded area is indicative that some cracking was evident from the tests. As can be seen, the standard '161 alloy of 20 Cr/4.5 Al is quite fabricable. But at a 30 Cr/4.5 Al level cracking was experienced. Some cracking was noted in the transverse direction with an alloy of approximately 19% chromium and 5.2% aluminum. The alloy containing 6.6% aluminum and about 25% chromium cracked excessively in the transverse direction, the bend angle being less than 50° versus a desired 105° or more. For purposes of fabricability the aluminum content, as noted above herein, advantageously should not exceed 6% and more preferably is not above 5.75%.

Apart from flat rolled products, the alloys contemplated herein can be used in hot worked and/or machined bar and other mill product shaped forms including forgings and tubing. It may be cost effective, for example, to machine components from bar for, say, flame guides or glass extrusion dies.

Although the present invention has been described in conjunction with preferred embodiments, it is to be understood that modifications and variations may be resorted to without departing from the spirit and scope of the invention, as those skilled in the art will readily understand. Such modifications and variations are considered to be within the purview and scope of the invention and appended claims.

We claim:

1. A flat rolled product such as sheet and strip characterized by good fabricability and enhanced resistance to oxidation at temperatures as high as 1300° C., said product being formed from an alloy consisting of about 23 to 30% chromium, about 5 to 6.25% aluminum, a small but effective amount of at least one dispersoid to enhance strength and selected from the group of materials having a melting point in excess of 1510° C. and consisting of oxides, nitrides, borides and refractory metals, up to 1% each of titanium, niobium, zirconium, hafnium, and vanadium, up to 6% each of molybdenum and tungsten, up to 0.5% silicon and niobium, up to 0.05% each of calcium, yttrium and rare earth metals, up to 0.2% boron, the balance being essentially iron, said product, by virtue of the respective percentages of chromium and aluminum, affording resistance to the onset of slagging attack and/or accelerated oxidation when subjected to operating environments at temperatures up to at least 1300° C.

2. The product of claim 1 in which the alloy contains from 0.2 to 0.75% titanium.

3. The product of claim 2 in which the aluminum of the alloy does not exceed 6% and chromium is from 23 to 27%.

4. The product of claim 1 in which the dispersoid of the alloy is one or more oxides in an amount up to 10 volume percent, carbides up to 1% volume percent, nitrides up to 5% by volume and borides up to 5% by volume.

* * * * *